US005095783A

United States Patent [19]

Majima

[11] Patent Number: 5,095,783

[45] Date of Patent: Mar. 17, 1992

[54] PLASTIC WRENCHING TOOL

[75] Inventor: Takeshi Majima, Sanjo, Japan

[73] Assignee: Top Kogyo Co., Ltd., Sanjo, Japan

[21] Appl. No.: 645,355

[22] Filed: Jan. 24, 1991

Related U.S. Application Data

[63] Continuation of Ser. No. 406,805, Sep. 13, 1989, abandoned, which is a continuation of Ser. No. 185,312, Apr. 20, 1988, abandoned, which is a continuation of Ser. No. 004,583, Jan. 20, 1987, abandoned.

[30] Foreign Application Priority Data

Jan. 28, 1986 [JP] Japan ..... 61-10777

[51] Int. Cl.[5] ..... B25B 13/16

[52] U.S. Cl. ..... 81/165; 81/166; 81/167

[58] Field of Search ..... 81/165, 175, 176

[56] References Cited

U.S. PATENT DOCUMENTS

| | | | |
|---|---|---|---|
| 532,634 | 1/1895 | Billings | 81/176 |
| 584,111 | 6/1987 | Ellrich | 81/176 |
| 593,882 | 11/1897 | Freas | 81/176 |
| 883,942 | 4/1905 | Vinton | 81/176 |
| 1,196,014 | 8/1916 | Nayda | 81/176 |
| 1,435,548 | 11/1922 | Oliver | 81/176 |
| 2,059,087 | 10/1936 | Carlson | 81/176 |
| 2,680,984 | 6/1954 | Ingwer | 76/114 |
| 2,991,677 | 7/1961 | Savarin | 81/176.3 |
| 4,030,847 | 6/1977 | Carmien | 403/369 |
| 4,367,969 | 1/1983 | Carmien | 81/20 |

FOREIGN PATENT DOCUMENTS

| | | | |
|---|---|---|---|
| 2018179 | 10/1979 | United Kingdom | 76/114 |

OTHER PUBLICATIONS

"Chemical Principles", by Masterton et al., Fourth Edition, Copyright date 1973.

*Primary Examiner*—Bruce M. Kisliuk
*Assistant Examiner*—Jack Lavinder
*Attorney, Agent, or Firm*—Spencer & Frank

[57] ABSTRACT

A plastic wrenching tool wherein the axes of the fixed and movable members are maintained substantially coincident, and rotation or displacement therebetween minimized by the provision of grooves and projections on the fixed and movable members respectively. At least the outer convex portion of the tool is made of resin. The resin material used is fibrous glass reinforced plastic which may be used for the entire tool. Specifically a fibrous glass reinforced nylon resin is used as the material of the tool. Alternatively, a matallic material may be used in a part or parts of the tool, such as in the outer concave surface portion, the inner portion of the tool, or the concave portion of the outer surface of the tool and the inner portion of the tool.

6 Claims, 1 Drawing Sheet

PLASTIC WRENCHING TOOL

This application is a continuation of application Ser. No. 07/406,805, filed Sept. 13, 1989, which is a continuation of Ser. No. 07/185,312, filed Apr. 20, 1988, which is a continuation of application Ser. No. 07/004,583 filed Jan. 20, 1987 which are now abandoned.

BACKGROUND OF THE INVENTION

1. Field of the Invention

The present invention relates to wrenching tools, such as wrenches, spanners, pliers, etc., and more particularly to such tools made of plastics, which are suitable for use in the vicinity of breakable ceramics, glasses or the like.

2. Discussion of the Prior Art

Main bodies of such tools have conventionally been made of steel, and plastic material has not been used for the main bodies for the reason that plastic is inferior to steel with respect to its mechanical properties, particularly with respect to its rigidity.

In some cases, plastics have been used as electrical insulation, or to provide better gripping. However, plastics have not been used in the main body portion of the tools, but only in the handle grip portion as a cover thereof. Tools entirely made of plastic have not been seen.

These plastic covered tools are frequently used when working on the piping for toilets, washrooms, bathrooms, etc., after construction of a house or building has been completed since the toilet bowls, washing bowls, etc., are in many cases made of ceramics, and the floors thereof are also made of ceramic tiles. If a steel tool is used for piping work involving ceramics, the tool may inadvertently hit against or be dropped on a ceramic member, and as a result the ceramic member might break. Repair of these broken ceramics requires much work, time and expense.

For example, a wrench used for twisting nuts and other similar elements usually consists of a main body (or fixed jaw) and a movable jaw engaged with the fixed jaw and movable in the axial direction of the main body. An example of such a conventional wrench is shown in FIG. 1, in which the fixed jaws 1 is made by forging, while the movable jaw 2 is made by casting. Since special mechanical care is not usually taken at the engaging portion 1*a* between the movable jaw 2, backlash frequently occurs there.

When plated nuts or nuts 4 made of soft metal, such as copper, brass, gun metal, etc., are used, the angle $\theta$ between the contact faces of the main body 1 and the movable jaw 2 becomes larger for $\Delta\theta$ compared with the normal case. Since the wrench has more rigidity than the material of the nut to be wrenched, the nuts may be damaged.

SUMMARY OF THE INVENTION

An object of this invention is to provide a plastic wrenching tool, which does not break breakable surroundings such as ceramics, tiles, etc., when used in the vicinity of breakable material and which does not even damage soft nuts.

A plastic wrenching tool according to the present invention is made of resin at least for its outer convex portion of the tool. The resin material is fibrous glass reinforced plastic. The resin may be used on the entire tool or, alternatively, a metallic material may be used in a part or parts of the tool, such as in the outer concave surface portion, the inner portion of the tool, or both the concave portion of the outer surface of the tool and the inner portion of the tool.

DESCRIPTION OF THE PREFERRED EMBODIMENTS

Figure 2:
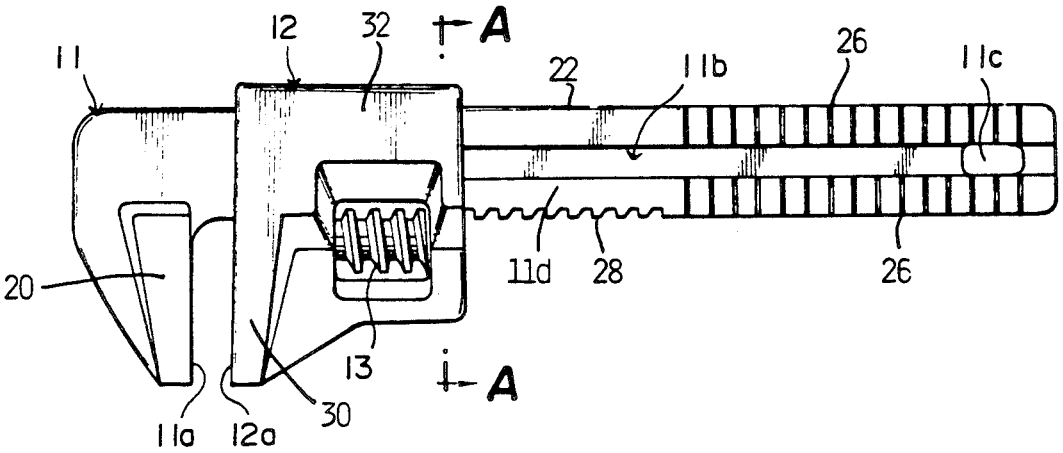
FIG. 2 is a front view of one preferred embodiment of the wrenching tool according to the present invention.

The preferred embodiments of the tool according to the present invention will be explained in detail with reference to FIGS. 2 and 3. FIG. 2 shows a motor wrench which is well used in various piping applications. In FIG. 2, the numeral 11 denotes a fixed member having a fixed jaw portion 20 and an elongated portion 22 which is the main body of the wrench. The elongated portion 22 has flat spaced parallel sides 24 (FIG. 3) each having a groove 11*b* therein and flat spaced parallel sides 26 interposed between the sides 24, a rack 28 being located on one of the sides 26. Each of the grooves 11*b* includes an indented flat surface 11*d* and a pair of spaced indentation sections 11*e* interposed between one of the sides 24 and the surface 11*d*.

A movable member 12 is provided with a movable jaw portion 30 substantially parallel to the fixed jaw portion 20 and a longitudinally extending portion 32 surrounding the elongated portion 22 of the fixed member 11. The longitudinally extending portion 32 includes flat spaced parallel sides 34 each having a protrusion 36 thereon and spaced parallel sides 42 interposed between the sides 34. Each of the protrusions 36 includes a projecting flat surface 38 and a pair of spaced projection sections 40 interposed between one of the sides 34 and the surface 38.

In this embodiment, the fixed member 11, the movable member 12 and a screw 13 for moving the movable member 12 in the axial direction of the fixed member 11 are all made of resin. A fibrous glass reinforced nylon, which is superior to the known resins with respect to its rigidity, is preferred.

In the embodiment, the fibrous glass reinforced nylon resin manufactured by Japanese manufacturer Toray Industries, Inc., is used. The resin is sold under the name of AMILAN (their trademark), which has a Type No. NYLON 6 and a Grade No. CM1011G-45. This resin is made using nylon resin and by adding thereto and reinforcing by 45% of glass short fibers, which are well known for their good mechanical strength, there is obtained stability against change in size, ease of forming, and less influence by temperature and humidity.

According to the technical report a fibrous glass reinforced plastic issued by Toray Industries, Inc., the plastic has mechanical properties which are comparable with die-cast aluminum when it is bone dry. The fibrous glass reinforced nylon also shows sufficient shock resistance. The bone-dry property comparison between the die-cast aluminum (No. SPE 903) and the fibrous glass reinforced nylon is realized from the above-mentioned technical report.

TABLE

| Property (23° C.) | Unit | ASTM Test | AMILAN CM1011G-45 (bone dry) | Die-cast Al (SPE 903) |
|---|---|---|---|---|
| specific gravity | — | D-792 | 1.48 | 2.71 |
| tensile strength | $Kg/cm^2$ | D-638 | 2000 | 3020 |
| tensile elongation | % | D-638 | 5.0 | 2.0 |
| bending strength | $Kg/cm^2$ | D-790 | 2900 | — |
| bending elastic modulus | $Kg/cm^2$ | D-790 | 1200 | 7000 |
| izod impact strength (with notch) | Kg · cm/cm | D-256 | 15 ~ 17 | — |
| Izod impact strength (without notch) | Kg · cm/cm | D-256 | 85 ~ 90 | — |
| Rockwell hardness (R scale/M scale) | — | D-785 | 121/95 | — |

The breakdown test made by the inventor using a two-head spanner with a thickness of the grip being 8.4 mm, width 18.3 mm and length 220 mm made from a plastic Grade No. CM1011G-45, resulted in the device breaking when a torque of 14 Kgm was applied. This value almost coincides with that of M equal to 13.4 Kgm, obtained from the equation $\sigma b = M/Z$, wherein $\sigma$b, M, Z are the maximum stress, moment, and modulus of section, respectively.

The grip position of a spanner or wrench in the handle is usually about 20 cm from the center of the nuts to be worked, and therefore the handle of the tool will break when wrenched or worked by the strength of about 70 Kg.

According to the above test result, the strength of the tool of the present invention has proved to be sufficient for the usual wrenching torque necessary for the usual piping work. It will be realized that even the plastic tool made entirely of plastic material is fully practicable in the usual piping work with breakable surroundings.

A wrench with an entire length of about 280 mm was produced with the above resin and a continuous load of 10 kgm/minute was applied to the head portion of the fixed member 11. As a result, no damage was seen at the faces 11*a*, 12*a* of the members 11 and 12 which were in contact with the nut and the tool could be used repeatedly thereafter.

Figure 3:
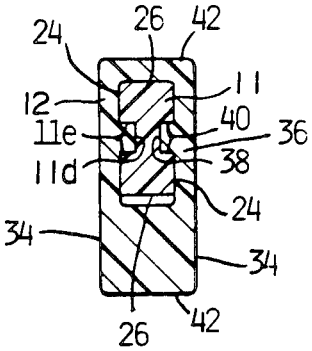
FIG. 3 is an A—A section of FIG. 2.

The groove 11*b* formed at each side of the elongated portion 22 of the fixed member 11 of the wrench, as clearly shown in FIG. 3, engages with respective protrusions 36 provided at the inner sides of the longitudinally extending portion 32 of the movable member 12 to guide the axial movement of the movable member. At one end of the grip of the elongated portion 22 of the fixed member 11, an opening 11*c* is provided for hanging the tool.

Abrasion mostly occurs at the contact faces 11*a*, 12*a* and at screw 13 which axially moves the movable member 12. The inventor of this invention used steel pieces and buried them at the contact faces 11*a* and 12*a* and also made the screw 13 of steel. As a result, abrasion could be decreased greatly, and this could prolong the life of the tool. Since these portions are all located in the concave or inner part of the tool body, none of the advantages of the plastic material mentioned above were lost, although the weight of the tool was somewhat increased.

Figure 1:
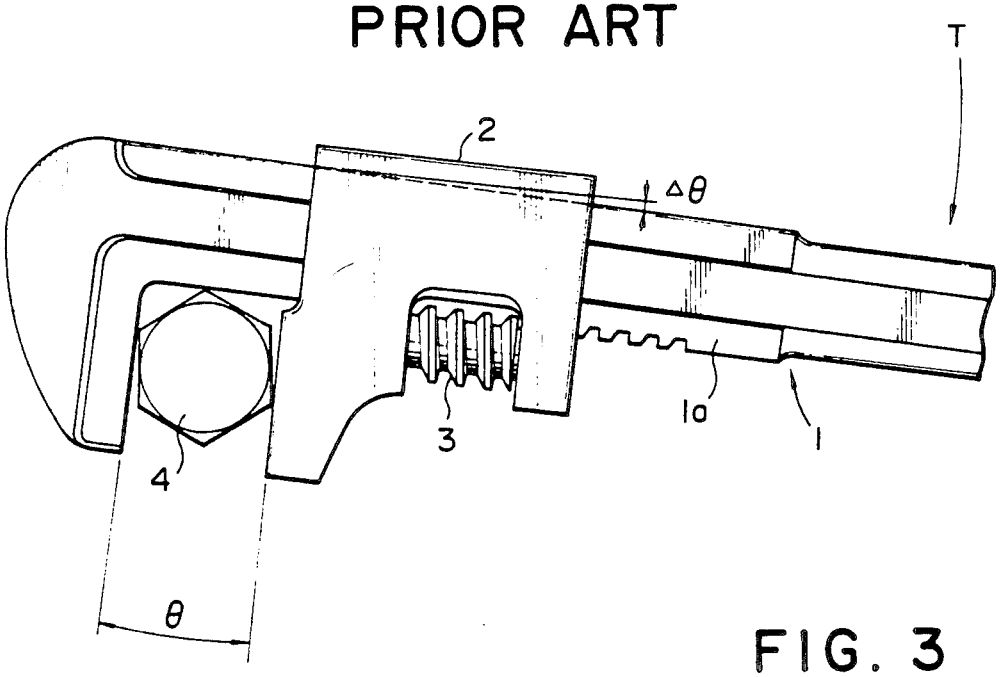
FIG. 1 PRIOR ART
FIG. 1 is an explanatory view of the conventional wrench showing the mouth between the jaws of the tool being opened by backlash.

As already explained with reference to FIG. 1, in the conventional wrench there has been the problem of backlash. In the wrench according to the present invention, the engaging portion between the fixed member 11 and movable member 12 are formed of a plastic material. Plastic material is good in formability, stability in change of size and is less influenced by the temperature and humidity. Therefore, sufficient precision of the engaging members may be obtained without any particular machining, and thus is immune from backlash. The surface hardness of the material is far softer than the steel product as shown in the Rockwell hardness section of the Table, and thus the tool of the present invention does not damage nuts or surfaces thereof.

Not only is the surface hardness of the tool small, but its specific gravity is small, and so even when the tool is hit by mistake against ceramics or dropped thereon, its moment of inertia or impact is small and it does not crack or damage the ceramics.

The drop test was made by dropping a wrench having an entire length of 250 mm from 100 cm above the ground onto spread ceramic tiles. None of the tiles cracked at all as a result of the test.

As fully explained above, most of or the entire plastic tool of the present invention is made of resin, such as the fibrous glass reinforced nylon so that the tool is soft in surface hardness and of light weight. Thus when they are used in the toilet rooms, washrooms, bathrooms, kitchens, etc., in the surroundings of the ceramics, tile floor or wall, and if it is hit against or dropped on them by mistake, it does not crack or damage the ceramic. Thus the present invention makes the piping operation safe and easy with these tools.

Also, the surface hardness of the plastic tools are softer than the steel tools. They do not damage plated nuts or nuts made of soft metal material, such as copper, brass, gun metal, etc. In the prior art wrench, the wrenching is made between the main body and the movable jaw, and there is the problem of backlash as already explained above, which may badly damage the nuts. On the other hand, since the tools of the present invention are made of plastic, higher precision in the engaging portions between the main body and the movable jaw may be easily obtained and it can wrench the soft nuts without damaging them.

What is claimed is:

1. A plastic wrenching tool comprising:

a fixed member having a longitudinal axis extending in a first direction, including a fixed jaw portion having a contact face extending in a second direction substantially transverse to said first direction; and an elongated portion extending in said first direction, said elongated portion including first and second flat spaced sides parallel to said second direction, each of said first and second sides having a groove therein extending in said first direction, and each of said grooves including an indented flat surface parallel to said second direction; and a pair of spaced indentation sections parallel to a third direction perpendicular to said first and second directions, said indentation sections being interposed between one of said first and second flat sides of said elongated portion of said fixed member and the indented flat surface of said groove; and third and fourth flat spaced sides parallel to said third direction interposed between the first and second flat sides of the elongated portion of said fixed member, said third flat side having a rack thereon extending in said first direction;

a movable member consisting of a single unit having a longitudinal axis substantially coincident with the longitudinal axis of said fixed member, including a movable jaw portion having a contact face extending in said second direction, the contact faces of said fixed and movable jaw portions being substantially parallel; and a longitudinally extending portion integrally and rigidly formed with said movable jaw portion surrounding the first, second, third and fourth sides of the elongated portion of said fixed member, said longitudinally extending portion including first and second flat spaced sides parallel to said second direction, each of said first and second sides having a protrusion thereon extending in said third direction, and each of said protrusions including a projecting flat surface parallel to said second direction; and a pair of spaced projection sections parallel to said third direction interposed between one of the flat sides of the longitudinally extending portion of said movable member and said projecting flat surface; and third and fourth spaced sides parallel to said third direction interposed between the first and second flat sides of said longitudinally extending portion of said movable member;

the first, second, third and fourth flat sides of the longitudinally extending portion of said movable member being closely adjacent to the first, second, third and fourth flat sides respectively of the elongated portion of said fixed member, and the protrusions from the first and second flat sides of the longitudinally extending portion of said movable member closely and slidably engaging the grooves in the first and second flat sides of the elongated portion of said fixed member respectively thereby maintaining the axes of said fixed and movable members substantially coincident and minimizing rotation or displacement of any portion of said movable member in a direction transverse to said longitudinal axes; and a metallic screw secured to said movable member for rotation about an axis extending parallel to said first direction, said screw being positioned within an aperture in the longitudinally extending portion of said movable member adjacent to and in engagement with said rack, rotation of said screw about said axis translating said movable member in said first direction with respect to said fixed member, said fixed and movable jaw portions being made of reinforced nylon resin material thereby minimizing backlash between said fixed and movable members and minimizing damage to objects being wrenched.

2. A plastic wrenching tool according to claim 1, wherein said reinforced nylon resin material contains approximately 45% of glass short fibers.

3. A plastic wrenching tool as defined in claim 1, wherein said fixed jaw portion and said movable jaw portion each has a metallic material embedded in its respective contact face.

4. A plastic wrenching tool according to claim 3, wherein said reinforced nylon resin material contains approximately 45% of glass short fibers.

5. A plastic wrenching tool according to claim 1, wherein the reinforced nylon resin material forming the entire surfaces of said fixed and movable jaws is made of fiber reinforced nylon resin material.

6. A plastic wrenching tool according to claim 1, wherein the reinforced nylon resin material forming the entire surfaces of said fixed and movable jaws is made of fibrous glass reinforced nylon resin material.

* * * * *